United States Patent [19]

Vigo et al.

[11] Patent Number: 4,871,615

[45] Date of Patent: Oct. 3, 1989

[54] TEMPERATURE-ADAPTABLE TEXTILE FIBERS AND METHOD OF PREPARING SAME

[75] Inventors: Tyrone L. Vigo; Cynthia M. Frost, both of Knoxville, Tenn.

[73] Assignee: The United States of America as represented by the Secretary of Agriculture, Washington, D.C.

[21] Appl. No.: 818,567

[22] Filed: Jan. 13, 1986

Related U.S. Application Data

[60] Division of Ser. No. 626,850, Jul. 2, 1984, which is a continuation-in-part of Ser. No. 409,266, Aug. 18, 1982, abandoned.

[51] Int. Cl.[4] ..... D02G 3/00

[52] U.S. Cl. ..... 428/398; 428/372; 428/376; 428/913

[58] Field of Search ..... 428/376, 398, 36, 913, 428/364, 372; 8/115.51, 115.6

[56] References Cited

U.S. PATENT DOCUMENTS 3,607,591 9/1971 Hansen et al. ..... 428/364

OTHER PUBLICATIONS

Hale, D. V., et al., "Phase Change Materials Handbook", NASA Report B72-10464, Aug. 1972.

Benson, D. K., et al., Proc. 11th American Thermal Analysis Conf., 1981.

Carlsson, B., et al., "Storage of Low-Temperature Heat in Salt-Hydrate Melts—Calcium Chloride Hexahydrate", Doc. D12:1978.

*Primary Examiner*—Lorraine T. Kendell

*Attorney, Agent, or Firm*—M. Howard Silverstein; Raymond C. Von Bodongen

[57] ABSTRACT

Temperature adaptable textile fibers are provided in which phase-change or plastic crystalline materials are filled within hollow fibers or impregnated upon non-hollow fibers. The fibers are produced by applying solutions or melts of the phase-change or plastic crystalline materials to the fibers.

7 Claims, No Drawings

TEMPERATURE-ADAPTABLE TEXTILE FIBERS AND METHOD OF PREPARING SAME

CROSS REFERENCE TO RELATED APPLICATIONS

This application is a division of application Ser. No. 626,850, filed July 2, 1984, which in turn is a continuation-in-part of Application Ser. No. 409,266, filed Aug. 18, 1982 now abandoned.

BACKGROUND OF THE INVENTION

1. Field of the Invention

This invention relates to modified textile fibers.

2. Description of the Prior Art

The concept of preparing a temperature-adaptable hollow textile fiber has been previously demonstrated and described in U.S. Pat. No. 3,607,591. This invention incorporates a gas into liquid inside the fiber that increases the diameter of the fiber and thus increases its thermal insulation value when the liquid solidifies and the solubility of the gas decreases. However, this invention exhibits serious limitations. It is limited to use with only hollow textile fibers and is only applicable in cold weather situations, i.e., when the environmental temperature drops below the freezing point of the liquid in the fiber. Furthermore, this modified hollow fiber system was not evaluated for its ability to reproduce its thermal effect after various heating and cooling cycles.

The aerospace industry has reported some phase-change materials (inorganic salt hydrates such as calcium chloride hexahydrate, lithium nitrate trihydrate, zinc nitrate, hexahydrate, and polyethylene glycol with an average molecular weight of 600) for uses in spacecraft (Hale, et al., "Phase Change Materials Handbook", NASA Contractor Report CR-61363, September 1971). These materials have also been used in solar collectors and heat pumps in residences (Carlsson, et al., Document D12:1978, Swedish Council for Building Research). However, in these and similar publications, the suitability of phase-change materials for effective and prolonged heat storage and release is influenced by the substrate in which they are stored, its geometry and thickness, the effect of impurities and the tendency of the phase-change materials to supercool and exhibit reversible melting and crystallization. Moreover, and perhaps the most significant deficiency and limitation of the above recommendations, is the fact that the phase-change materials were recommended as incorporated into metal containers, plastic pipes and other nonporous substrates or very thick insulation such as wall board. No process or suitable conditions for the incorporation of these types of materials into hollow or non-hollow textile fibers has been described. Therefore, the problem of choosing a textile fiber and combining it with a phase-change material in order ot produce thermal storage and release properties that could be retained for a minimum of 5 heating and cooling cycles is an extremely difficult one.

In addition to substances that store or release thermal energy due to melting and/or crystallization (phase-change materials) there is another class of substances that are characterized by their high enthalpies or thermal storage and release properties. These substances are commonly called plastic crystals, and have extremely high thermal storage or release values that occur prior to and without melting, i.e., they have thermal energy available without undergoing a change of state such as solid to liquid (melting) or liquid to solid (crystallization). Although the precise reasons why plastic crystals exhibit such unique thermal behavior prior to a change of state have not been verified, this thermal effect is believed to be due to a conformational and/or rotational disorder in these substances. Plastic crystal materials such as pentaerythritol and other polyhydric alcohols have been recommended for use in passive architectural solar designs and active solar dehumidifier or solar cooling systems (D. K. Benson, et al., proc. Eleventh No. Am. Thermal Analysis Conf. 1981) because of their high thermal storage and release values that occur much below their melting point. However, as with the phase-change materials, no process or suitable conditions for the incorporation of these plastic crystals into hollow or non-hollow textile fibers has been described.

SUMMARY OF THE INVENTION

Temperature-adaptable textile fibers are provided which store heat when the temperature rises and release heat when the temperature decreases, in which phase-change or plastic crystalline materials are filled within hollow fibers, or impregnated upon non-hollow fibers.

The fibers are produced by dissolving the phase-change or plastic crystalline materials in a solvent such as water, thereafter filling the hollow fibers, or impregnating the non-hollow fibers, with the solution, followed by removal of the solvent. Alternatively, in the case of phase-change materials, the material may be applied to the fibers from a melt rather than solution.

The resultant product is a modified fiber which is temperature adaptable in both hot and cold environments for as many as 150 heating and cooling cycles, by releasing heat when the temperature drops, and storing heat when the temperature rises. As such, fabrics made from such fibers may be used to protect plants and animals, may be incorporated in protective clothing, and generally speaking may be employed in environments where temperature fluctuations need to be minimized.

DESCRIPTION OF PREFERRED EMBODIMENTS

In the practice of the present invention the phase-change or plastic crystalline materials which are to be filled into such hollow fibers as rayon or polypropylene, or impregnated into non-hollow fibers such as cotton or rayon, first are dissolved in a solvent to form a solution. Water is a suitable solvent in most instances, although some materials are more readily dissolved in alcohol such as ethyl alcohol or fluorinated hydrocarbons such as carbon tetrachloride.

Wide ranges of solution concentrations are suitable. The solution should not be too viscous that it interferes with the ability of the solution to fill the hollow fibers or to evenly impregnate the non-hollow fibers, and it should not be too dilute that only minimal amounts of material are deposited within or on the fibers.

Previously known techniques for filling hollow fibers are suitable, such as taught in "Hollow Fibers—Manufacture and Application", editor Jeanette Scott, published by Noyes Data Corp., 1981, and includes metering the desired aqueous solution into the hollow fibers as they are formed by extrusion during wet spinning.

As to impregnating non-hollow fibers, prviously known immersion and coating techniques for textile fibers are suitable, such as techniques for finishing or dyeing, or imparting fire-retardancy or wash-and-wear.

As a laboratory procedure for filling small numbers of fibers, the following method may be employed: A plurality of fibers are formed into a bundle. One end of the bundle is immersed in solution, while the other end is snuggly inserted into an open end of a plastic or rubber tube or hose which is connected to an aspirator, thereby drawing solution into the fibers.

After the solution has filled the hollow fibers, or has coated the non-hollow fibers, sovlent is removed from the solution to deposit the material within or upon the fibers. Prior art solvent removal techniques in the textile art are suitable, such as air drying or oven drying. These techniques are well known in connection with fabric finishing or dyeing, or imparting flame-retardancy or wash-and-wear to textiles. In some instances, the solvent can be removed by reduced pressure or solvent extraction.

In the case of non-hollow fibers, a preliminary solvent removal step may be included such as the use of squeeze rollers to remove excess solvent prior to drying. Such a preliminary step is well known in the textile treatment art.

During the primary drying step, the temperature preferably is maintained below the melting point of the phase-change material or below the solid-to-solid transition temperature of the plastc crystalline material.

After removal of solvent, in the case of hollow fibers, the fiber ends may be sealed as taught in the previously mentioned book on hollow fibers, and thereafter the fibers may be formed into woven or non-woven fabric. With regard to impregnating non-hollow fibers, the step of treating the fibers with solution of the phase-change or plastic crystalline material preferably is carried out after the fibers have already been formed into fabric.

As an alternative to dissolving the phase-change material in a solvent prior to application to the fibers, such materials may first be melted. Thereafter the melt itself is filled into or impregnated upon the fibers and subsequently cooled for the purpose of resolifification.

Any phase-change or plastic crystalline material which is chemically and physically compatible with the fibers is suitable, which can be determined through routine experimentation. The expression "chemically and physically compatible", as used in the specification and claims, means that the material does not react with the fibers so as to lose its phase-change or transition properties, is capable of being filled within the hollow fiber, or impregnated upon the non-hollow fiber, and, specifically with regard to phase-change materials, the material must be able, in its liquid phase, to be retained within the hollow fiber, or remain impregnated upon the non-hollow fibers. The expression "phase-change material", as used herein, refers to materials which transform fromsolid to liquid and back, at a particular temperature; and "plastic crystalline material" refers to material which changes from one solid composition to another, and back, at a particular temperature. It will be obvious that only those materials whose temperature of phase change or transition falls within a temperature of practical use for the resultant fabric ordinarily should be employed in the practice of the present invention, although, under special circumstances, it may be useful to employ a material whose phase change or transition temperature falls outside this normal range.

Preferably the phase-change materials are selected from the group consisting of congruent inorganic salt hydrates and polyethylene glycols, while the plastic crystalline materials are polyhydric alcohols. More particularly, the phase-change materials are selected from the group consisting of calcium chloride hexahydrate in admixture with strontium chloride hexahydrate, lithium nitrate trihydrate. and zinc nitrate hexahydrate, and polyethylene glycols having 7 to 56 monomer units with an average molecular weight ranging from 400 to 3350.

The polyhydric alcohols preferably are selected from the group consisting of pentaerythritol, 2,2-dimethyl-1,3-propanediol, 2-hydroxymethyl-2-methyl-1,3-propanediol, or amino alcohols such as 2-amino-2-methyl-1,3-propandiol.

With regard to specific phase-change and plastic crystalline materials, preferred concentrations (weight percent of solution) in aqueous solutions for application to fibers are as follows (in some cases the amount of material which is deposited in or on specific types of fibers, after solvent removal, also is given):

(a) 10–40% sodium sulfate decahydrate in combination with 3–10% sodium borate decahydrate added to prevent supercooling.

(b) 45–80% calcium chloride hexahydrate in combination with 1–2.5% strontium chloride hexahydrate added to prevent supercooling, corresponding to 0.5–10.0 grams of material per gram of rayon or cotton fibers, and 0.4–1.6 grams per gram of polypropylene fiber.

(c) 80–95% zinc nitrate hexahydrate, which corresponds to 0.5–17.0 grams per gram of rayon or cotton, and 1.0 to 1.6 grams per gram of polypropylene.

(d) 80–100% lithium nitrate trihydrate which corresponds to 3–10 grams per gram of rayon or cotton, and 0.2–1.4 grams per gram of polypropylene.

(e) 15–65% polyethylene glycol (400–3350 m.w.), which corresponds to 0.5–12.0 grams per gram of rayon or cotton, and 0.2–1.2 grams per gram of polypropylene.

(f) 20–40% pentaerythritol, which corresponds to 1.0–2.0 grams per gram of rayon or cotton, and 0.4–0.8 grams per gram of polypropylene.

(g) 40–60% 2-amino-2-methyl-1,3-propanediol which corresponds to 0.4–2.8 grams per gram of rayon or cotton, and 0.8–1.2 grams per gram of polypropylene.

(h) 40–60% 2,2-dimethyl-1,3-propanediol which coresponds to 0.4–2.8 grams per gram of rayon or cotton, and 0.7–1.1 grams per gram of polypropylene.

(i) 40–60% 2-hydroxymethyl-2-methyl-1,3-propanediol which corresponds to 0.5–5.0 grams per gram of rayon or cotton, and 0.6–1.0 grams per gram of polypropylene.

The capabilities of phase-change materials in the practice of the present invention varies from one material to another. For example, many congruent inorganic salt hydrates exhibit a loss in thermal effectiveness and a tendency to supercool after 50 heating and cooling cycles, whereas polyethylene glycol does not do so up to 150 cycles. As another example, sodium sulfate decahydrate in combination with sodium borate decahydrate loses its effectiveness after 5 heating and cooling cycles. Likewise, there is a variation among the plastic crystalline materials. For example, pentaerythritol is only moderately effective because it has a tendency to sublime from the fibers on prolonged thermal cycling.

As a general rule, the plastic crystalline materials are more advantageous than the phase-change materials since the thermal storage and release effects of the former are not dependent on melting and crystallization, and often occur at temperaturs much below such melting or crystallization temperatures. Modified fibers containing suitable plastic crystal materials have little tendency to supercool or lose thermal effectiveness on prolonged thermal cycling.

The hollow fibers preferably are rayon and polypropylene of the single cavity type, but any holow fiber type such as polyester or polyamide, and hollow fiber geometry such as multiple cavity are suitable. The non-hollow fibers preferably are cotton, mercerized cotton, rayon fibers, yarns and/or fabrics, but other non-hollow fibers are suitable such as wool and polyamides.

Fibers with high moisture regain, i.e. 4% or greater, such as rayon or cotton are preferred to fibers such as polypropylene for incorporation of congruent inorganic salt hydrates because rayon and cotton prolongs the number of thermal cycles for which the modified fibers are thermally effective. That is, these phase-change materials lose some waters of hydration or lose waters of hydration at a rate much faster than rehydration after prolonged thermal cycling. Rayon and cotton are superior to polypropylene in such situations because (a) rayon and cotton have a greater affinity and capacity for congruent inorganic salt hydrates and provide initially higher thermal storage and release values; and (b) they retain these desirable thermal characteristics for a longer number of cycles because of their ability to provide water from the fiber and thus minimize or retard dehydration of the hydrates.

Hydrophilic fibers are superior to hydrophobic fibers in many instances because the former have much greater affinity for polyethylene glycol than the latter. Presumably this is due to their hydrophilic nature and ability to form hydrogen bonds with these phase-change materials; and thus, fibers such as rayon or cotton retain greater amounts of the polyethylene glycol.

The minimum length of the hollow fibers that are to be filled generally should be about 10 mm, because smaller fibers are difficult to handle. The preferred length is at least 30 mm. There is no maximum length, and thus continuous filaments can be filled with the materials herein. Any non-hollow fiber length and geometry may be modified by the present invention. The process is suitable for treatment of woven and non-woven yarns and fabrics or any other textile structure derived from non-hollow fibers.

The thermal transfer properties of the product of the present invention are illustrated in the following examples.

EXAMPLE 1

Incorporation of Polyethylene Glycol (av. molecular wt. of 600) into Hollow Rayon Fibers Hollow rayon fibers (38 mm in length) were tied into a parallel fiber bundle, tightly aligned inside an O-ring in a vertical position, and a 57% aq. solution of polyethylene glycol with an average molecular weight of 600 (Carbowax 600) aspirated through the fibers under reduced pressure for 30 minutes or until the solution was visually observed to be at the top of the fiber. The modified fibers were then cooled at −15° C. for 1 hour and dried at 18° C. for 24 hours to remove excess water and cause the phase-change material to solidify. Excess solid on the exterior of the fiber was removed, then the fiber was conditioned at 25° C./45% RH in a dessicator containing $KNO_2$ to produce a modified fiber containing on a weight/weight basis, 7.0 grams of Carbowax 600 per gram of rayon fiber. The modified fibers were then evaluated for up to 150 heating and cooling cycles at −40° to +60° C. for their ability to store and release thermal energy by differential scanning calorimetry. At 1 heating and cooling cycle, the thermal energy available for storage on increasing temperature was 39.1 calories/gram in the temperature interval of −3 to +37° C. and the thermal energy available for release on decreasing temperature 42.6 calories/gram in the temperature interval of −23° to 17° C.

After 150 thermal cycles, the thermal energy available for storage ws 41.9 calories/gram and for release 41.0 colories/gram for the same temperature intervals.

In contrast, unmodified hollow rayon fibers after 1 heating and cooling cycle exhibited fairly linear behavior and had in the same temperature range, thermal storage values of 16.2 calories/gram and release values of 14.9 calories/gram due only to the specific heat of the unmodified fiber.

EXAMPLE 2

Incorporation of Polyethylene Glycol (av. molecular wt. of 600) into Hollow Polypropylene Fibers Hollow polypropylene fibers (135 mm in length) were prepared and treated as in Example 1 with a 57% aqueous solution of polyethylene glycol (Carbowax 600), cooled, dried and conditioned, as in Example 1, to produce a modified fiber containing 1.2 grams of Carbowax 600 per gram of polypropylene fiber. When the modified hollow fibers were evaluated by thermal analysis for up to 50 heating and cooling cycles at −40° to +60° C., their thermal energy available or storage after 1 heating and cooling cycle was 32.3 calories/gram in the temperature interval of −3° to +37° C. (increasing temperature) and for release 31.5 calories/gram in the temperature interval of the −23° to +17° C. (decreasing temperature). After 50 thermal cycles, thermal energy for storage in the modified fibers was 35.2 calories/gram and for release 26.9 calories/gram at the saem temperature intervals for heating and cooling.

In contrast, unmodified hollow polypropylene fibers after 1 heating and cooling cycle exhibited fairly linear behaviour and had in the same temperature intervals, thermal storage values of 16.9 calories/gram and release values of 15.4 calories/gram, due to only the specific heat of the unmodified fibers.

EXAMPLE 3

Incorporation of Polyethylene Glycol (av. molecular wt. of 3350) into Hollow Polypropylene Fibers Hollow polypropylene fibers were treated as an Example 2 with a 57.2% aqueous solution of polyethylene glycol (Carbowax 3350), cooled, dried, and conditioned, as in Example 1, to produce a modified fiber containing 1.0 gram of Carbowax 3350 per gram of polypropylene fiber. When the modified hollow fibers were evaluated by thermal analysis for up to 50 heating and cooling cycles at −40° to +80° C., their thermal energy available for storage after 1 heating and cooling cycle was 35.6 calories/gram in the temperature intervl 42° to 77° C. (increasing temperature) and for release 33.5 calories/gram in the temperature interval of 17° to 52° C. (decreasing temperature). After 50 thermal cycles, thermal energy for storage in the modified fibers was 32.8 calories/gram and of release 34.3 calories/- gram at the same temperature intervals for heating and cooling.

EXAMPLE 4

Incorporation of Polyethylene Glycol (av. molecular wt. of 3350) Into Hollow Rayon Fibers Hollow rayon fibers were treated with the same concentration of Carbowax 3350 as in Example 3, cooled, dried, and conditioned, as in Example 1, to produce a modified fiber containing 11.3 grams of Carbowax 3350 per gram of rayon fiber. Evaluation of the modified hollow fibers by calorimetry for up to 50 heating and cooling cycles at −40° to +80° C., indicated that their thermal energy available for storage after 1 heating and cooling cycle way 43.5 calories/gram in the temperature interval of 42° to 77° C. and for release 49.6 calories/gram in the temperature interval of 17°-53° C. After 50 thermal cycles at the same temperature intervals, thermal energy for storage in the modified fibers was 43.3calories/gram and for release 47.1 calories/-gram.

EXAMPLE 5

Incorporation of Polyethylene Glycol (av. molecular wt. 1000) into Hollow Rayon Fibers A 57.4% aqueous solution of polyethylene glycol (Carbowax 1000) was aspirated through hollow rayon fibers under reduced pressure, cooled, dried, and conditioned, as in Example 1, to produce a modified hollow fiber containing 10.8 grams of Carbowax 1000 per gram of rayon fiber. When the modified fibers were evaluated by calorimetry for up to 50 thermal cycles at −40° to +60° C. their thermal energy available for storage after 1 heating cycle was 43.2 calories/gram in the temperature interval of 17° to 52° C. and for release after 1 cooling cycle 41.8 calories/gram in the temperature interval of −3° to 32° C. After 50 thermal cycles, thermal energy for storage in the modified fibers was 43.5 calories/gram and for release 41.6 calories/gram at the same temperature intervals of heating and cooling.

EXAMPLE 6

Incorporaton of Polyethylene Glycol (av. molecular wt. 400) into Hollow Polypropylene Fibers A 57.1% solution of polyethylene glycol (Carbowax 400) was aspirated through hollow polypropylene fibers under reduced pressure, cooled, dried, and conditioned, as in Example 1, to produce a modified hollow fiber containing 1.2 grams of Carbowax 400 per gram of polypropylene fiber. Evaluation of the modified fibers by calorimetry for up to 10 heating and cooling cycles at −40° to +60° C. indicated thermal storage values of 28.5 calories/gram (temperature interval: −28° to +12° C.) and release values of 24.9 calories/gram (temperature interval: −48° to −8° C.) after 1 heating and cooling cycle, respectively. After 10 thermal cycles, the thermal storage and release values at the same temperature intervals were respectively 28.1 calories/gram and 25.7 calories/gram.

EXAMPLE 7

Incorporation of Polyethylene Glycol (av. molecular wt. of 600) into Cotton Fabric 100% Desized, scoured, and bleached cotton printcloth (3.15 oz/yd$^2$; thread count 84 warp×76 fill; 1 ft. wide×9 ft. long) was immersed in a 50% aqueous soluton of polyethylene glycol (Carbowax 600) at 25° C., then excess solution removed by running the treated fabric through a squeeze roller to a wet pickup of 100%. Two one ft.$^2$ samples were removed from the treated fabric, one of which was placed on a flat surface and allowed to air-dry overnight for 24 hours at 15° C., and the other dried for 85 seconds at 75° C. in a Mathis Laboratory Dryer (one that stimulates commercial drying without liquid migration). The drying procedure is to effect solidification of the phase-change material on the fabric. After drying, each treated fabric was conditioned, as described as in Example 1, to give a modified fabric containing 0.6 grams of Carbowax 600 per gram of cotton fabric. When the modified cotton fabrics were evaluated by thermal analysis at −23° to +37° C., their thermal energy available for storage was 18-20 calories per gram for 1 or 10 heating cycles, with little difference in these values for fabrics dried by each method. Similar results were obtained for thermal energy available for release (16-18 calories per gram for 1 or 10 cooling cycles). In contrast, the unmodified cotton fabric had thermal storage values of 11-2 calories per gram and release values of 10.5-11.8 calories per gram in the same temperature intervals, due only to the specific heat of the unmodified fibers.

EXAMPLE 8

Incorporation of $LiNO_3.3H_2O$ into Hollow Rayon Fibers

Pure $LiNO_3.3H_2O$ was melted at 30° C., then aspirated under reduced pressure into hollow rayon fibers that were subsequently cooled, dried, and conditioned, as in Example 1, to produce a modified hollow fiber containing 9.5 grams of lithium nitrate trihydrate per gram of rayon fiber. The modified fibers were then evaluated up to 50 thermal cycles at −40° to +60° C. Their thermal energy available for storage after 1, 10, and 50 heating cycles was respectively 72.4, 74.7, and 37.4 calories/gram, and for thermal release after 1, 10, and 50 cooling cycles, 53.1, 42.2, and 9.8 calories/gram, with progressive supercooling occurring by 50 cycles. Temperature intervals for all heating cycles for measuring thermal storage were 17° to 42° C., while the temperature interval chosen for cooling cycles varied, and was −1° to 9° C., −7° to +2° C., and −22° to 17° C. for 1,10, and 50 cooling cycles, respectively.

Although the rayon/lithium nitrate trihydrate system lost its thermal effectiveness on prolonged cycling, it was superior to either the pure $LiNO_3.3H_2O$ alone or to this phase change material incorporated into the polyporpylene hollow fiber. After 1 and 10 cycles thermal storage values for the pure $LiNO_3.3H_2O$ were 65.8 and 23.0 calories/gram (1 and 10 cycles) and 30.5 and 22.1 calories/gram (1 and 10 cycles) for the lithium nitrate thrihydrate incorporated into the polypropylene fiber at a ratio of 1.9 grams/gram of fiber after cooling, drying and conditioning. On cooling, similar trends were observed. After 1 and 10 cooling cycles, and pure $LiNO_3.3H_2O$ had thermal storage values of 50.0 and 2.3 calories/gram and the $LiNO_3.3H_2O$-treated fibers corresponding values of 4.7 and 0.2 calories/gram, the latter due only to specific heat of the polypropylene fiber. Temperature values varied, particularly with cooling cycles, and generally were measured at intervals reflecting the peak temperature mid-point of crystallization on cooling.

EXAMPLE 9

Incorporation of $Zn(NO_3)_2.6H_2$) into Hollow Rayon Fibers

An 89.7% aqueous solution of $Zn(NO_3)_2.6H_2O$ was incorporated into hollow rayon fibers (38 mm in length) that were cooled, dried, and conditioned, as in Example 1, to produce a modified fiber with 15.0 grams of zinc nitrate hexahydrate per gram of rayon fiber. When the modified fiber was evaluated between −40° to +60° C. by differential scanning calorimetry; it produced 28.6 calories per gram for thermal storage (temperature interval: 22° to 46.6° C.), and 16.9 calories/gram for thermal release (temperature interval: −3° to 9° C.) after 1 cycle. After 5 thermal cycles, the corresponding thermal storage and release values were 36.6 calories/gram on heating (same temperature interval as 1 heating cycle) and 12.9 calories/gram on cooling (temperaure interval: −3° to +9° C.).

When the same concentration of the above phase-change material was incorporated into hollow polypropylene fibers, the modified fibers contained 1.4 grams of zinc nitrate hexahydrate per gram of polypropylene. On their evaluation by calorimetry, their thermal storage values for the 1 and 5 heating cycles were respectively, 23.3 and 24.9 calories/gram (temperature interval: 22° to 48° C.) and for thermal release after 1 and 5 cycles, 8.2 and 5.7 calories/gram (temperature interval: 12° to 20° C.), with the latter value due only to the specific heat of the polypropylene fiber.

EXAMPLE 10

Incorporation of $CaCl_2.6H_2O/SrCl_2.6H_2O$ into Hollow Rayon Fibers

A 49.4% $CaCl_2.6H_2O$/1.0°% $SrCl_2.6H_2O$ aqueous solution was aspirated through hollow rayon fibers that were dried, cooled, and conditioned, as in Example 1, to produce a modified fiber containing 3.2 grams of calcium chloride hexahydrate/strontium chloride hexahydrate per gram of rayon fiber. When the modified fiber was evaluated by calorimetry at −40° to +60° C., it had thermal storage values of 11 calories/gram (temperature interval: 22° to 37° C.) and release values of 14 calories/gram (temperature interval: −8° to +17° C.) after 1 thermal cycle. After 10 heating and cooling cycles, its thermal storage value was 17 calories/gram and release value 16 calories/gram (same temperature interval as 1 cycle).

EXAMPLE 11

Incorporation of $Na_2SO_4.10H_2O/Na_2B_4O_7.10H_2O$ into Hollow Rayon Fibers A 40% $Na_2SO_4.10H_2O$/10% $Na_2B_4O_7.10H_2O$ aqueous solution was aspirated through hollow rayon fibers that were dried, cooled and conditioned, as in Example 1, to produce a modified fiber containing 0.1 gram of sodium sulfate decahy drate/borax per gram of rayon fiber. When the modified fiber was evaluated by calorimetry at −40° to +60° C., it was practically indistinguishable from unmodified hollow rayon fibers in its thermal storage and release properties after 5 heating and cooling cycles, and exhibited no pronounced endotherms or exotherms (associated with storage and release effects) even after only 1 heating and cooling cycle, although operable for one cycle. Consequently. all phase-change materials do not work to the same degree.

EXAMPLE 12

Incorporation of 2,2-Dimethy1-1,3-propanediol into Hollow Rayon Fibers

Hollow Rayon fibers cut from tow (135 mm in length) were prepared and treated, as in Example 1, with a 50% aqueous solution of 2,2-dimethy1-1,3-propanediol (DMP), cooled, dried and conditioned as in Example 1 to produce a modified fiber containing 2.8 grams of DMP per gram of rayon fiber. When the modified hollow fibers were evaluated by thermal analysis for up to 50 heating and cooling cycles at 7° to 62° C., their thermal energy available for storage after 1 heating and cooling cycle was 30.5 calories/gram in the temperature interval of 32° to 62° C. (increasing temperature) and for release 27.2 calories/gram in the temperature interval of 37° to 7° C. (decreasing temperature). After 50 thermal cycles, thermal energy for storage in the modified rayon fibers was 29.5 calories/gram and for release 26.4 calories/gram at the same temperature intervals for heating and cooling. In contrast, unmodified hollow rayon fibers after 1 heating and cooling cycle exhibited fairly linear behavior and had in the same temperature intervals, thermal storage values of 9.3 calories/gram and release values of 8.7 calories/gram, due to only the specific heat of the unmodified fibers.

EXAMPLE 13

Incorporation of 2,2-Dimethy1-1,3-propanediol into Cotton Fabric

100% cotton printcloth, desized, scoured, and bleached (3.15 oz/yd$^2$; thread count 84 warp×76 fill; 1 ft. wide×9 ft. long) was immersed in a 50% aqueous solution of DMP, then excess solution removed from the fabric by running the treated fabric through a squeeze rolled to a wet pickup of 100%. Two 1 ft$^2$ samples were removed from the treated fabric, one of which was placed on a flat surface and allowed to air-dry overnight for 24 hours at 15° C., ad the other dried for 85 seconds at 75° C. in a Mathis Laboratory Dryer (one that simulates commercial drying without liquid migration). The drying procedure is to effect solidification of the phase-change material on the fabric. After drying, each treated fabric was conditioned as described in Example 1 to give a modified fabric containing 0.6 grams of DMP per gram of cotton fabric. When these modified fabrics were evaluated by thermal analysis at 7° to 62° C., their thermal energy available for storage was 18–21 calories/gram for 1 or 10 heating cycles, with little difference in these values for fabrics dried by each method. Similar results were obtained for thermal energy available for release (16–18 calories/gram for 1 or 10 cooling cycles). In contrast, the unmodified cotton fabric had thermal storage values of 8.6–9.12 calories/gram and release values of 7.9–8.14 calories/gram in the same temperature intervals, due only to the specific heat of the unmodified fibers.

EXAMPLE 14

Treatment of Non-hollow Rayon Fibers with 2,2-Dimethy1-1,3-propanediol

Staple rayon fibers (as two-plied yarn, 32–50 mm staple length; 30.7 mg/m denier) were immersed in excess 50% aqueous DMP solution, centrifuged for 5 minutes at 2080 rmp to remove excess DMP, cooled, dried and conditioned, as in Example 12, to produce a modified fiber containing 0.4 grams of DMP per gram of rayon fiber. When the treated rayon fibers were evaluated by thermal analysis for up to 50 heating and cooling cycles at 7° to 62° C., their thermal energy for storage after 1 heating and cooling cycle was 15.3 calories/gram in the temperature interval 32° to 62° C. (increasing temperature) and for release 12.4 calories/gram in the temperature interval of 37° to 7° C. (decreasing temperature). After 50 thermal cycles, thermal energy for storage of the treated rayon fibers ws 12.5 calories/gram and for release 11.2 calories/gram at the same temperature intervals for heating and cooling.

EXAMPLE 15

Incorporation of 2-Hydroxymethyl-2-methyl-1,3-propanediol into Hollow Polypropylene Fibers Hollow polypropylene fibers were treated, as in Example 12, with a 50% aqeuous solution of 2-hydroxymethyl-2-methyl-1,3-propanediol (HMP), cooled, dried and conditioned as above to produce a modified fiber containing 0.8 grams of HMP per gram of polypropylene fiber. When the modified hollow fibers were evaluated by thermal analysis for up to 50 heating and cooling cycles at 47° to 102° C., their thermal energy available for storage after 1 heating and cooling cycle was 32.7 calories/gram in the temperature interval of 72° to 102° C. (increasing temperature) and for release 28.8 calories/gram in the temperature interval of 77° to 47° C. (decreasing temperature). After 50 thermal cycles, thermal energy for storage in the modified fibers was 31.7 calories/gram nd for release 28.4 calories/gram at the same temperaure intervals for heating and cooling.

EXAMPLE 16

Treatment of Cotton Fibers with 2-Hydroxymethyl-2-methyl-1,3-propanediol

Cotton fibers (as mercerized sewing thread-three plied, 23–32 mm staple length and a denier of 31.8 mg/m) were immersed in excesss 50% aqueous HMP solution, centrifuged for 5 minutes at 2080 rpm to remove excess HMP, cooled, dried and conditioned as in Example 12 to produce a modified fiber containing 0.7 grams of HMP per gram of cotton fiber. When the treated cotton fibers were evaluated by thermal analysis for up to 50 heating and cooling cycles at 47° to 102° C., their thermal energy for storage after 1 heating and cooling cycle was 27.5 calories/gram in the temperature interval 72° to 102° C. (increasing temperature) and for release 23.4 calories/gram in the temperature interval of 77° to 47° C. (decreasing temperature). After 50 thermal cycles, thermal energy for storage of the treated cotton fibers was 25.3 calories/gram and for release 23.2 calories/gram at the same temperature intervals for heating and cooling. In contrast, untreated cotton fibers after 1 heating and cooling cycle exhibited fairly linear behavior and had in the same temperature intervals, thermal storage avlues of 10.0 calories/gram and release values of 8.9 calories/gram due to the specific heat of the unmodified fibers.

EXAMPLE 17

Treatment of Cotton Fibers with 2-Amino-2-methyl-1,3-propanediol

Cotton fibers (as mercerized sewing thread-three plied 25–32 mm staple length and a denier of 31.8 mg/m) were immersed in excess 50% aqueous 2-amino-2-methyl-1,3-propanediol (AMP), excess AMP removed and the fibers cooled, dried and conditioned as in Example 16 to produce modified cotton fibers containing 1.1 grams of AMP per gram of cotton fiber. When the treated cotton fibers were evaluated by thermal analysis for up to 50 heating and cooling cycles at −3° to 102° C., their thermal energy for storage after 1 heating and cooling cycle was 37.8 calories/gram in the temperature interval 72° to 102° C. (increasing temperature) and for release 20.0 calories/gram in the temperature interval of 92° to 52° C. (decreasing temperature). After 50 thermal cycles, thermal energy for storage of the treated cotton fibers was 30.2 calories/gram and for release 18.6 calories/gram at the same temperature intervals for heating and cooling.

EXAMPLE 18

Incorporation of Pentaerythritol into Hollow Rayon Fibers

Hollow rayon fibers cut from two (135 mm in length) were prepared and treated, as in Example 12, with a 30% aqueous solution of pentaerythritol (PET), cooled, drid and conditioned, as in Example 12, to produce a modified fiber containing 12. grams of PET per gram of hollow rayon fiber. When the modified hollow fibers were evaluated by thermal analysis for up to 10 heating and cooling cycles at 152° to 207° C., their thermal energy available for storage after 1 heating and cooling cycle was 39.5 calories/gram in the temperature interval of 177° to 207° C. (increasing temperature) and for release 34.0 calories/gram in the temperature interval of 182° to 152° C. (decreasing temperature). After 50 thermal cycles, thermal energy for storage and release in the modified hollow rayon fibers was indistinguishable form the untreated hollow rayon fibers.

We claim:

1. Temperature-adaptable hollow textile fibers which store heat when the temperature rises and release heat when the temperature decreases, the hollow of said fibers filled with a material consisting essentially of a phase-change or plastic crystalline material which stores heat when the temperature rises and releases heat when the temperature decreases and which is chemically and physically compatible with said fibers, wherein said fibers are selected from the group consisting of rayon, polyethylene, polyester and polyamide.

2. Temperature-adaptable hollow textile fibes which store heat when the temperature rises and release heat when the temperature decreases, the hollow of said fibers filled with a material consisting essentially of a phase-change or plastic crystalline material which stores heat when the temperature rises and releases heat when the temperature decreases and which is chemicaly and physically compatible with said fibers, wherein said phase-change materail is selected from the group consisting of congruent inorganic salt hydrates and polyethylene glycols, and wherein said plastic crystalline material is a polyhydric alcohol.

3. The fibers of claim 1 wherein said phase-change material is selected from the group consisting of congruent inorganic salt hydrates and polyethylene glycols, and wherein said plastic crystalline material is a polyhydric alcohol.

4. The fibers of claim 2 wherein said phase-change material is selected from the group consisting of calcium chloride hexahydrate in admixture with strontium chloride hexahydrate, lithium nitrate trihydrate, and zinc nitrate hexahydrate,and wherein said plastic crystalline material is selected from the group consisting of pentaerythritol, 2,2-dimethyl-1,3-propanediol, 2-hydroxymethyl-2-methyl-1,3-propanediol, and amino alcohols.

5. The fibers of claim 3 wherein said phase-change material is selected from the group consisting of calcium chloride hexahydrate in admixtue with strontium chloride hexahydrate, lithium nitrate trihydrate, and zinc nitrate hexahydrate, and wherein said plastic crystalline mterial is selected from the group consisting of pentaerythritol, 2,2-dimethyl-1,3-propanediol, 2-hydroxymethyl-1-methyl-1,3-propanediol, and amino alcohols.

6. The fibers of claim 3 wherein said fibers are filled with a polyhydric alcohol.

7. The fibers of claim 3 wherein said fibers are filled with a material selected from the group consisting of congruent inorganic salt hydrates, and polyethylene glycols.

* * * * *